US005330305A

United States Patent [19]

Go

[11] Patent Number: 5,330,305

[45] Date of Patent: Jul. 19, 1994

[54] DRIVEN MECHANISM FOR A THREE DIMENSIONAL VEHICLE PARKING SYSTEM

[75] Inventor: Junichi Go, Gifu, Japan

[73] Assignee: Fujihensokuki Co., Ltd., Gifu, Japan

[21] Appl. No.: 867,182

[22] PCT Filed: Apr. 12, 1991

[86] PCT No.: PCT/JP91/01692

§ 371 Date: Jun. 5, 1992

§ 102(e) Date: Jun. 5, 1992

[87] PCT Pub. No.: WO92/10629

PCT Pub. Date: Jun. 25, 1992

[30] Foreign Application Priority Data

Dec. 11, 1990 [JP] Japan ..... 2-415768

[51] Int. Cl.[5] ..... E04H 6/06

[52] U.S. Cl. ..... 414/254; 414/273; 414/279; 414/243; 414/252; 191/1 R

[58] Field of Search ..... 414/254, 243, 264, 231, 414/235, 253, 286, 273, 279, 261, 262, 252, 255, 256, 241, 232, 234, 227, 228, 284, 282, 274, 266, 267, 786; 191/1 R, 4; 364/478

[56] References Cited

U.S. PATENT DOCUMENTS

| | | | |
|---|---|---|---|
| 3,063,580 | 11/1962 | Dierks | 414/243 |
| 3,896,955 | 7/1975 | Collins et al. | 414/254 |
| 3,973,685 | 8/1976 | Loomer . | |
| 3,984,012 | 10/1976 | Ennis et al. | 414/231 |
| 4,265,581 | 5/1981 | Ives et al. | 414/254 X |
| 4,286,911 | 9/1981 | Benjamin | 414/273 |
| 4,950,117 | 8/1990 | Go | 414/254 |
| 5,002,449 | 3/1991 | Kita et al. | 414/279 X |

FOREIGN PATENT DOCUMENTS

| | | | |
|---|---|---|---|
| 3968668 | 1/1970 | Australia . | |
| 3653389 | 10/1989 | Australia . | |
| 1107720 | 8/1955 | France | 414/243 |
| 153332 | 8/1985 | Japan | 414/273 |
| 61-64969 | 4/1986 | Japan . | |
| 86272 | 4/1987 | Japan . | |
| 0238673 | 4/1987 | Japan . | |
| 264103 | 11/1987 | Japan | 414/252 |
| 280107 | 12/1987 | Japan | 414/273 |
| 49870 | 2/1990 | Japan | 414/254 |
| 276705 | 11/1990 | Japan | 414/279 |

*Primary Examiner*—Frank E. Werner
*Attorney, Agent, or Firm*—Stetina and Brunda

[57] ABSTRACT

A three dimensional parking system (1) includes a plurality of housing stations (X1, Y1, etc.) which are arranged in a vertical direction for accommodating vehicles. A lift compartment (31) is provided adjacent to the housing stations (X1, Y1, etc.). Lifts (4) are vertically movable in the lift compartment while carrying a vehicle thereon. A movable platform (7) carries the vehicle, and is capable of transferring the vehicle to and from the lifts (4). The platform (7) includes drive wheels (9), a drive motor (25) for driving the drive wheels (9), and an energy storage device (19). The energy storage device (19) supplies electrical power to the drive motor (25) when the platform (7) is driven. Therefore, the platform (7) moves between the housing station (X1, Y1, etc.) and the lift compartment (31) under its own ability.

5 Claims, 5 Drawing Sheets

DRIVEN MECHANISM FOR A THREE DIMENSIONAL VEHICLE PARKING SYSTEM

TECHNICAL FIELD

This invention relates to a three dimensional parking system having lifts and movable platforms for carrying vehicles. More particularly, it relates to a mechanism for driving a platform adapted to move a vehicle between the platform and lifts by means of fork beams formed in a comblike arrangement.

BACKGROUND ART

As disclosed in Japanese Unexamined Patent Publication (Kokai) No. 62-86272, a three dimensional parking system is known, in which a vehicle is transferred between a movable platform having comblike fork beams for carrying a vehicle and lifts having comblike fork beams. As shown in FIG. 8, this three dimensional parking system includes housing stations 41, 42 provided on each floor for accommodating vehicles, and a lift compartment 43 defined between the housing stations 41, 42 for allowing lifts 44 to be moved upward or downward.

A plurality of separate drive rollers 45 are provided on the same level at the opposite ends of each of the housing stations 41, 42 and the lift compartment 43. Further, driver motors 46 are provided in each of the housing stations 41, 42 and the lift compartment 43 for the respective groups of these drive rollers.

Each drive motor 46 and its corresponding drive rollers 45 are connected by a chain which is driven by the drive motor 46. By driving these groups of drive rollers 45 simultaneously, a movable platform 47 used to carry vehicles is moved on the drive rollers to a predetermined position in the housing stations 41, 42 or to a predetermined position in the lift compartment 43.

However, since a plurality of drive rollers 45 are provided in each of the housing stations 41, 42 and the lift compartment 43, it is required to adjust the level of the drive rollers 45 so as to level the groups of the drive rollers 45 with each other. Therefore, the conventional three dimensional parking system presents a drawback, namely that significant labor and time are required for maintenance.

It is an object of the present invention to provide a drive mechanism for a three dimensional vehicle parking system which can be easily maintained, by improving a drive mechanism which drives a movable platform for carrying a vehicle.

DISCLOSURE OF INVENTION

The three dimensional parking system of the present invention includes a plurality of housing stations that are arranged in a vertical direction for accommodating vehicles. A lift-moving passage is provided adjacent to the housing stations. Lifts are vertically movable along the lift-moving passage while carrying vehicles. A movable platform carries the vehicles, and is capable of transferring these vehicles between the lifts and the platform. A platform is provided in each one of the housing stations.

Each platform comprises drive wheels, a drive motor for driving the drive wheels, and an energy storage device. The energy storage device stores electrical power supplied from an outside source, and supplies the stored electrical power to the drive motor when the platform is driven. Therefore, each platform can move independently between the housing station and part of the lift-moving passage adjacent thereto.

BEST MODE FOR CARRYING OUT THE INVENTION

One embodiment of the invention will be described below with reference to drawings.

Figure 1:
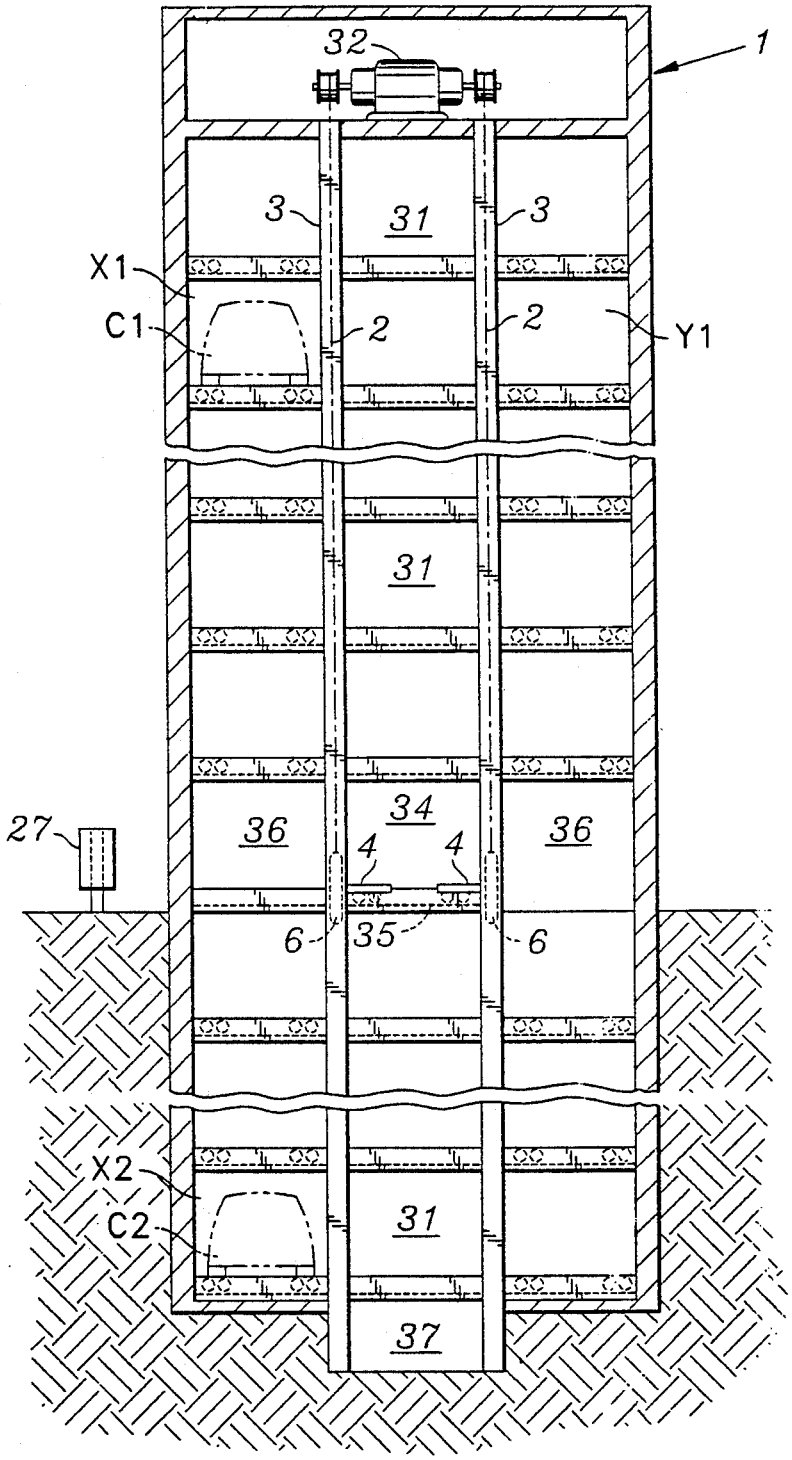
FIG. 1 is a longitudinal cross-sectional view showing a three dimensional parking system according to an embodiment of the present invention.

FIG. 1 shows a three dimensional parking system 1 having four guide rails 3 (only two of which are shown) erected in the central area. A plurality of housing stations (X1, X2, Y1) are vertically arranged on the right and left sides of the guide rails 3. Further, a lift compartment 31 surrounded by the four guide rails 3 is defined between the housing stations (X1, X2) on the left side and the housing stations (Y1) on the right side.

Figure 2:
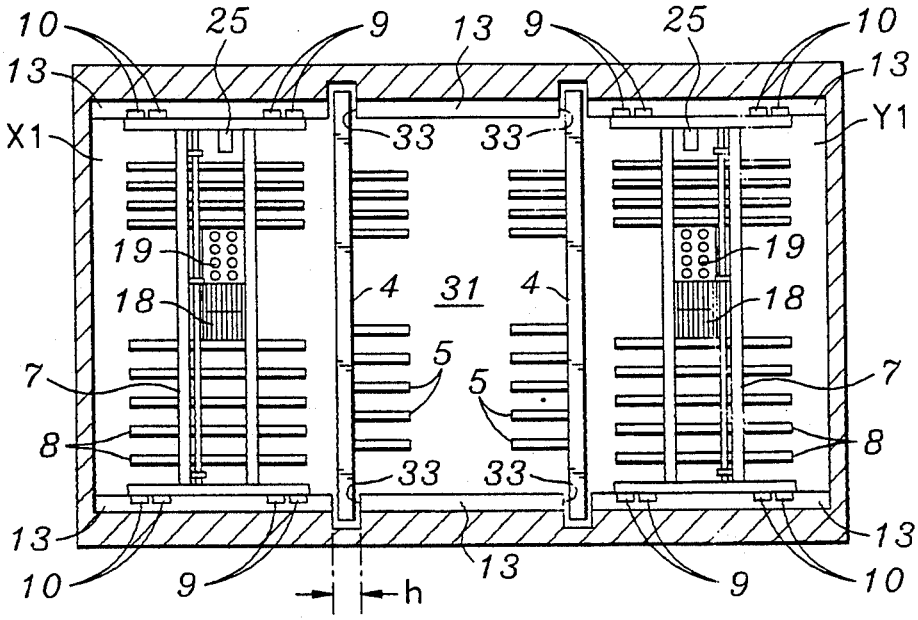
FIG. 2 is a horizontal sectional view of the three dimensional parking system shown in FIG. 1.

As shown in FIG. 2, a pair of platform rails 13 are arranged in each of the housing stations (X1, X2, Y1) and the lift compartment 31 on each floor. Within the three dimensional parking system 1, a plurality of movable platforms 7 for carrying vehicles, are provided in the respective housing stations (X1, X2, Y1, etc.) and are traversable along the platform rails 13.

Figure 3:
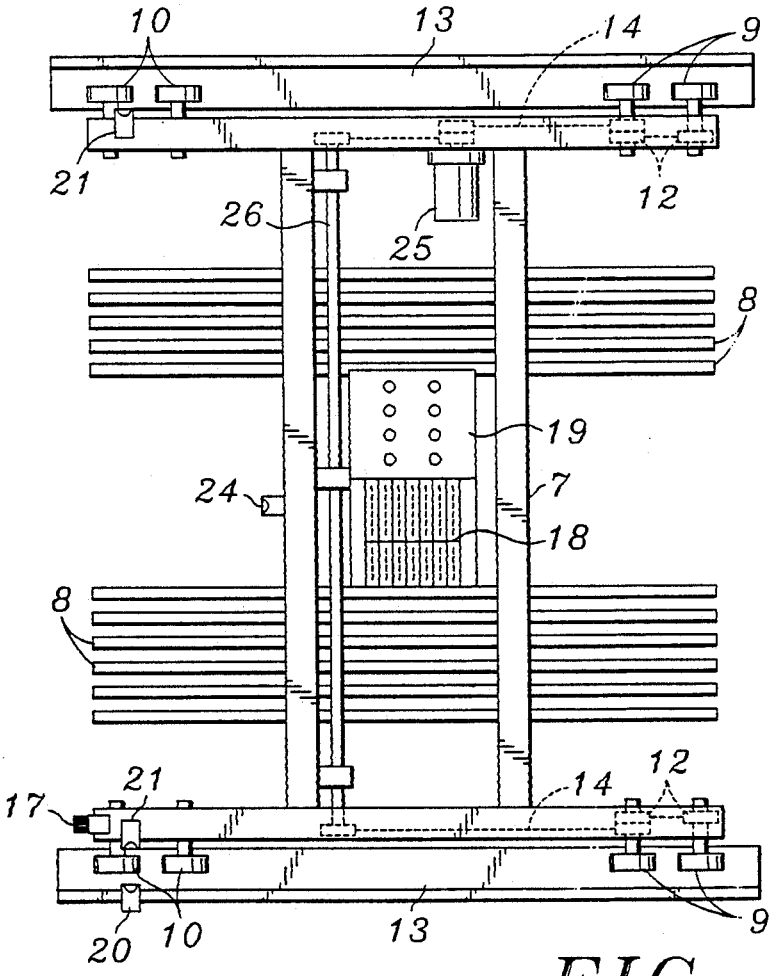
FIG. 3 is an enlarged plan view showing a movable platform for carrying a vehicle.
Figure 4:
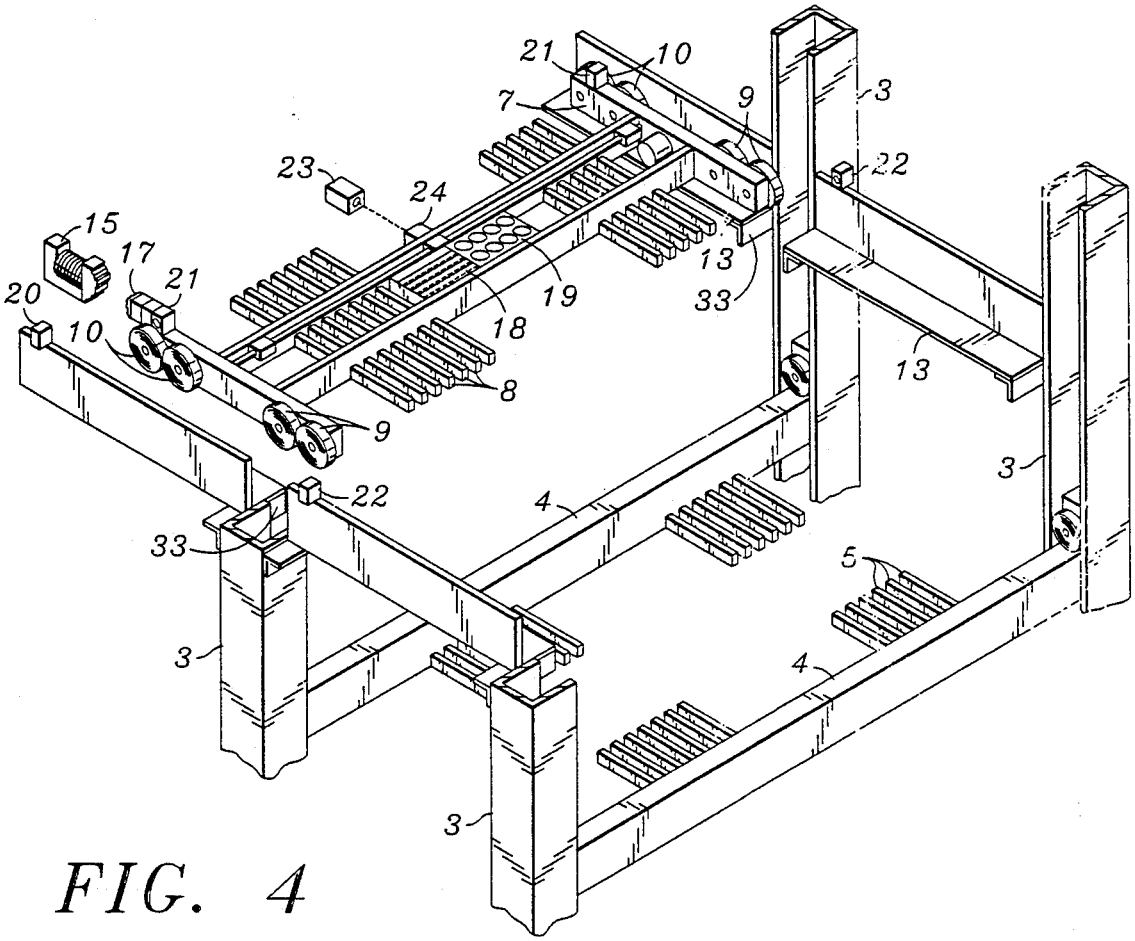
FIG. 4 is a perspective view showing the lifts and the platform.

As shown in FIGS. 2 to 4, each platform 7 has drive wheels 9 and idle wheels 10 provided at each of the front and rear ends of the platform. The drive wheels 9 and the idle wheels 10 are provided in pairs, such that each pair of wheels includes adjacent right and left wheels of the same kind. The platforms 7 are arranged on each floor and move back and forth along the platform rails 13 between the housing stations (X1, Y1, etc.) on the floor and the lift compartment 31.

As shown in FIG. 1, suspension mechanisms 6 are arranged on the guide rails 3, and are movable therealong. Lift drivers 32 are installed in the top compartment of the three dimensional parking system 1. Wires 2, which can be reeled up by the lift drivers 32, are suspended from the drivers. The suspension mechanisms 6 are suspended at the same level by the wires 2.

One lift 4 is horizontally arranged on a pair of front and rear suspension mechanisms 6, such that the parking system 1 has a pair of lifts 4 which are vertically movable along the guide rails 3. Each lift has a plurality of lift fork beams 5 formed in a comblike arrangement. These lift fork beams 5 extend toward the center of the lift compartment 31.

As shown in FIG. 3, each platform 7 has a plurality of platform fork beams 8 which extend in the central part thereof in the right and left directions. The lift fork beams 5 freely pass between the platform fork beams without contacting them, when the platform 7 moves into the lift compartment 31, and when the lift fork beams move in the upward and downward directions within the lift compartment 31. When a vehicle is loaded either on the platform fork beams 8 or on the lift fork beams 5, the lift fork beams 5 pass through the platform fork beams 8, and the vehicle is transferred from one set of fork beams onto the other set of fork beams.

As shown in FIG. 3, sprocket wheels 12 are mounted on the shafts of the drive wheels 9, such that they rotate in unison with the shafts. A platform motor 25 is mounted on a front frame of the platform 7. Further, a shaft 26 is rotatably supported between the front and rear frames of the platform 7.

The rotation of the platform motor 25 is simultaneously transmitted to the front sprocket wheels 12 via a chain 14, and to the rear sprocket wheels 12 via the shaft 26 and chains 14. The front and rear drive wheels 9 are driven by the platform motor 25 at the same rotational speed. As a result, the platform 7 travels straight on the platform rails 13, in a perpendicular direction to the surface of the views shown in FIGS. 2 and 3.

As shown in FIGS. 2 and 4, the platform rails 13 in the housing stations and those in the lift compartment 31 are not continuously connected to each other. Gaps 33 between the rails 13 allow the lifts 4 to pass between the platform rails. The distance between the adjacent right and left drive wheels 9 and the distance between the adjacent right and left idle wheels 10 of the platform 7 are set to a value which is greater than the width h of the gaps 33.

Therefore, when the platform 7 travels back and forth between the housing station (X1, Y1) and the lift compartment 31, both drive wheels 9 do not simultaneously fall in the gap 33, nor do both idle wheels 10. Hence, in spite of the existence of the gaps 33, the platform 7 smoothly travels back and forth between the housing station (X1, Y1) and the lift compartment 31.

As shown in FIG. 3, a controller 18 and an energy storage device 19 are arranged in the center of the platform 7. The energy storage device 19 serves as a power source for devices installed on the platform 7, such as the platform motor 25 and the controller 18.

As shown in FIGS. 3 and 4, a connector 17 is arranged on one end of the platform 7. The housing stations (X1, X2, Y1) are provided with charging devices 15 which are connectable to a corresponding connector 17. When the connector 17 of the platform 7 is brought into contact with the associated charging device 15, the energy storage device 19 on the platform 7 charges up.

Further, an emitter 23 of the regulator (23, 24) is provided in each of the housing stations (X1, X2, Y1). The platform 7 carries a receptor 24 of the regulator (23, 24) opposite to the emitter 23. The emitter 23 emits a beam of light in the direction of the receptor 24, in response to instructions from a console panel 27. The console panel 27 is located on the ground.

When the receptor 24 detects light which is emitted from the emitter 23 while the platform 7 is stopped or not moving, the controller 18 starts to drive the platform motor 25. When the receptor 24 detects light from the emitter 23 while the platform 7 is operational, the controller 18 stops driving the platform motor 25. The emitter 23 emits an instruction signal for stopping mainly when the platform 7 must be stopped immediately, such as in case of an emergency.

As shown in FIG. 4, receptors 21 of the detector (20, 21, 22) are mounted on the front and rear portions of the platform 7, respectively. A second emitter 20 of the detector (20, 21, 22) is arranged in one of the front and rear inner walls of each housing station (X1, X2, Y1). Further, the first emitters 22 of the detector (20, 21, 22) are arranged in the front and rear inner walls of the lift compartment 31, respectively.

When one of the receptors 21 on the platform 7 detects light from the second emitter 20 or from the first emitters 22, the controller 18 stops driving the platform motor 25. Thus, the platform 7 is controlled such that it stops in a predetermined standing position within each housing station (X1, X2, Y1), or in a predetermined standing position within the lift compartment 31.

Figure 5:
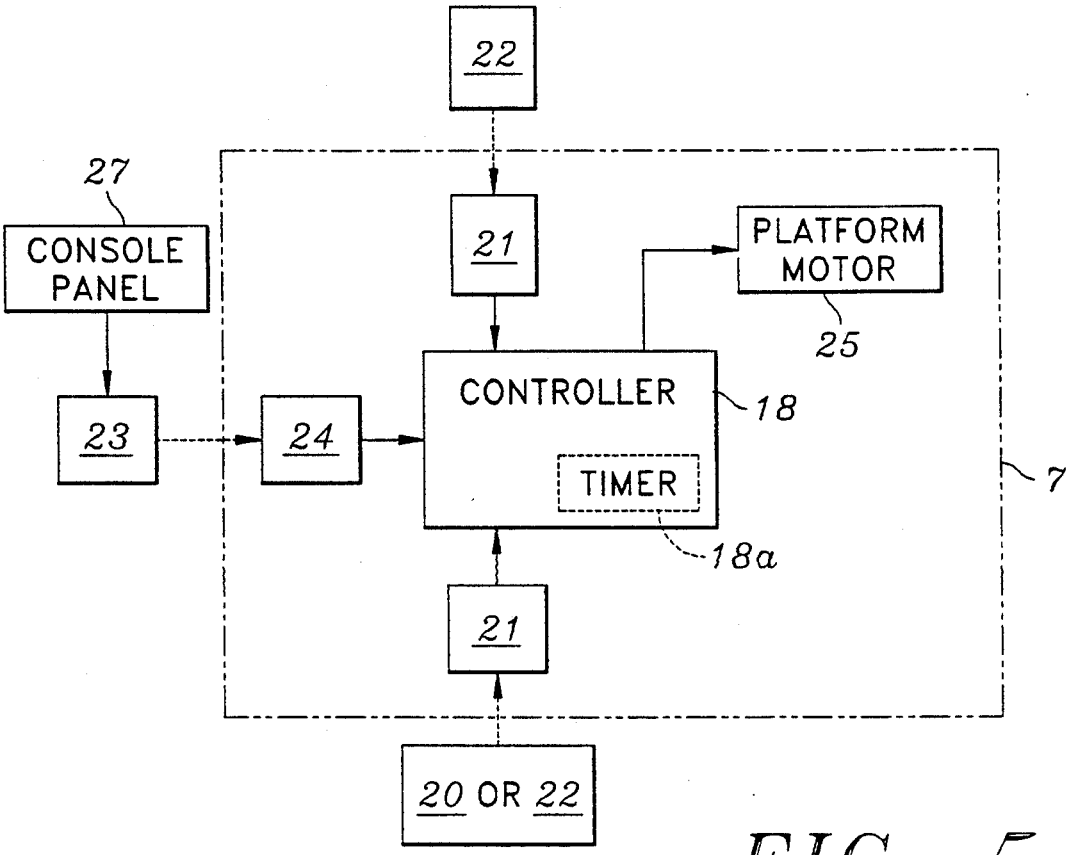
FIG. 5 is a block diagram useful in explaining a control mechanism of the platform.
Figure 8:
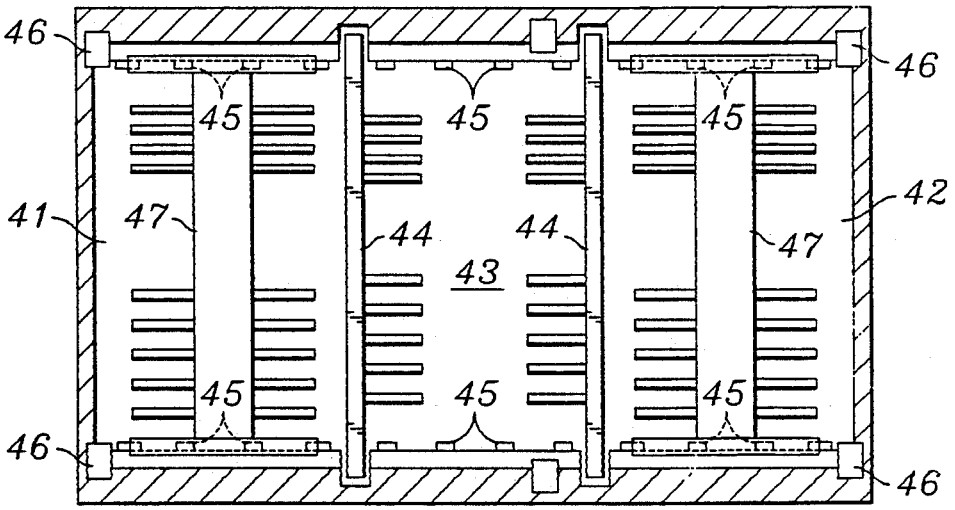
PRIOR ART FIG. 8
FIG. 8 is a horizontal sectional view showing a conventional three dimensional parking system.

As shown in FIG. 5, the controller 18 incorporates a timer 18*a*. The controller 18 performs a sequential control of the rotational speed of the platform motor 25 according to timing measured by the timer 18*a*, to thereby properly change the travelling speed of the platform 7.

The method of parking a vehicle C1 in the housing station X1 located above the ground level. First, the vehicle C1 is driven into a drive-in station 34 provided on the ground floor or level of the parking system 1. The vehicle C1 is parked such that its wheels are positioned on the lift fork beams 5 of the lifts 4. The drive-in station 34 is provided with a movable plateau 35 which is slidable in the horizontal direction, and which normally fills a gap between the lifts 4. Therefore, the vehicles and persons can safely pass through the drive-in station 34.

The driver and passengers, if any, can then go through the waiting stations 36, adjacent to the drive-in station 34, to exit the parking system 1. The driver or one of the passengers can move the vehicle C1, which is parked in the drive-in station 34, inside the housing station X1 by operating the console panel 27 located outside the parking system 1.

In response to instructions from the console panel 27 for moving the vehicle, both lifts 4 start to ascend. The lifts 4 with the vehicle C1 loaded on the lift fork beams 5 ascend to a position higher than the level of the platform 7 in the housing station X1.

Meanwhile, in response to instructions from the console panel 27 for moving or transferring the vehicle, the emitter 23 in the housing station X1 emits a signal. When the receptor 24 on the platform 7 detects the emitted signal, the controller 18 starts to drive the platform motor 25.

Under the control of the controller 18, the platform motor 25 is started at a low speed. Afterwards the rotational speed of the platform motor 25 increases to cause the platform 7 to travel at high speed. The platform 7 then moves into the lift compartment 31, whereupon the platform 7 decelerates. When the receptors 21 on the platform 7 detect the signals emitted from the first emitters 22, the controller 18 stops driving the platform motor 25. As a result, the platform 7 is stopped in a predetermined position within the lift compartment 31.

Thereafter, both the lifts 4 are slowly lowered. As the lifts 4 go down, the lift fork beams 5 pass between the platform fork beams 8. By passing of the lift fork beams 5 through the platform fork beams 8, the vehicle C1 is transferred from the lift fork beams 5 onto the platform fork beams 8. After the transfer of the vehicle C1, the lifts 4 return to the drive-in station 34 at a high speed.

The platform 7 with the vehicle C1 loaded thereon travels toward the housing station X1. The speed of the platform 7 is controlled by the controller 18. When the receptor 21 on the platform 7 detects the signal emitted from the second emitter 20, the platform motor 25 ceases to be driven.

Thus, the vehicle C1, which is carried on the platform 7, is transferred to the housing station X1. The vehicle C1 could be transferred or moved into the housing station Y1, by a similar procedure.

Next, a method for accessing and removing the vehicle C2 parked in an underground housing station X2.

In response to instructions from the console panel 27 for taking out the vehicle, both lifts 4 descend from the level of the drive-in station 34 to a pit 37 provided at the bottom of the lift compartment 31, and are held there. Subsequently, the emitter 23 in the housing station X2 sends out a signal. When the receptor 24 on the platform 7 detects this signal, the platform 7 travels and stops within the lift compartment 31.

As the lifts 4 ascend the vehicle C2 is transferred from the platform fork beams 8 onto the lift fork beams 5, and the platform 7 returns to its original position. Furthermore, as the lifts 4 ascend from the pit 37, the movable plateau 35 slides to open the underground part of the lift compartment 31.

The lifts 4 move up to a position higher than the level of the movable plateau 35. When the lifts 4 pass the level of the plateau 35, the plateau 35 returns to its original position to close the underground part of the lift compartment 31 again. When the lifts 4 go down to the level of the plateau 35, a driver would be able to access and get inside the vehicle C2.

The platform 7 according to the present embodiment has the wheels 9, 10, the platform motor 25, the energy storage device 19, etc. incorporated therein, so that it operates with a drive mechanism provided outside the platform 7. Accordingly, it is not required to provide power supply wirings for motors, drive rollers, chains, etc. in the housing stations or the lift compartment. Therefore, maintenance on the three dimensional parking system 1 according to the present embodiment can be much more easily carried out than the maintenance on conventional parking system, and the cost for maintenance is reduced.

Further, the present invention is not limited to the embodiment described above, and the following variations can be made.

Figure 6:
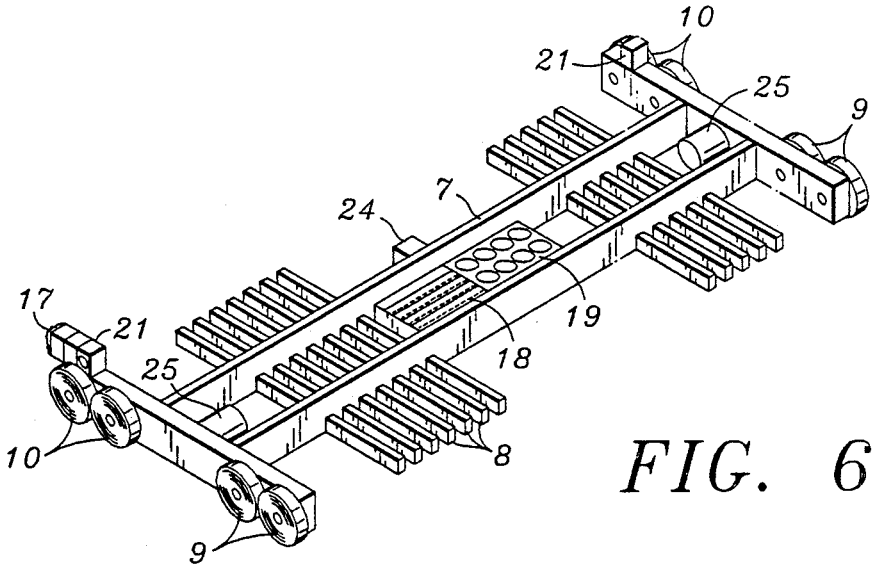
FIG. 6 is a perspective view showing a variation of the platform.

(1) As shown in FIG. 6, in which the shaft 26 is omitted, two platform motors 25 may be provided on the front and rear frames of the platform 7 for driving the front drive wheels 9 and the rear drive wheels 9, respectively.

(2) In the embodiment described, the emitter 23 in the housing station and the receptor 24 on the platform 7 are used for emitting and receiving an instruction signal for starting the platform 7 as well as one for stopping the platform 7. In another embodiment, an emitter and receptor for starting the platform, and an emitter and receptor for stopping the platform in case of emergency may be separately provided.

(3) In the embodiment described above, there is used a transmission type photoelectric detector comprising a emitter-receptor combination. In place of the transmission type photoelectric detector, there may be used a reflection type photoelectric detector, an infrared switch, a limit switch, a proximity switch which senses proximity of a metal, etc.

Figure 7:
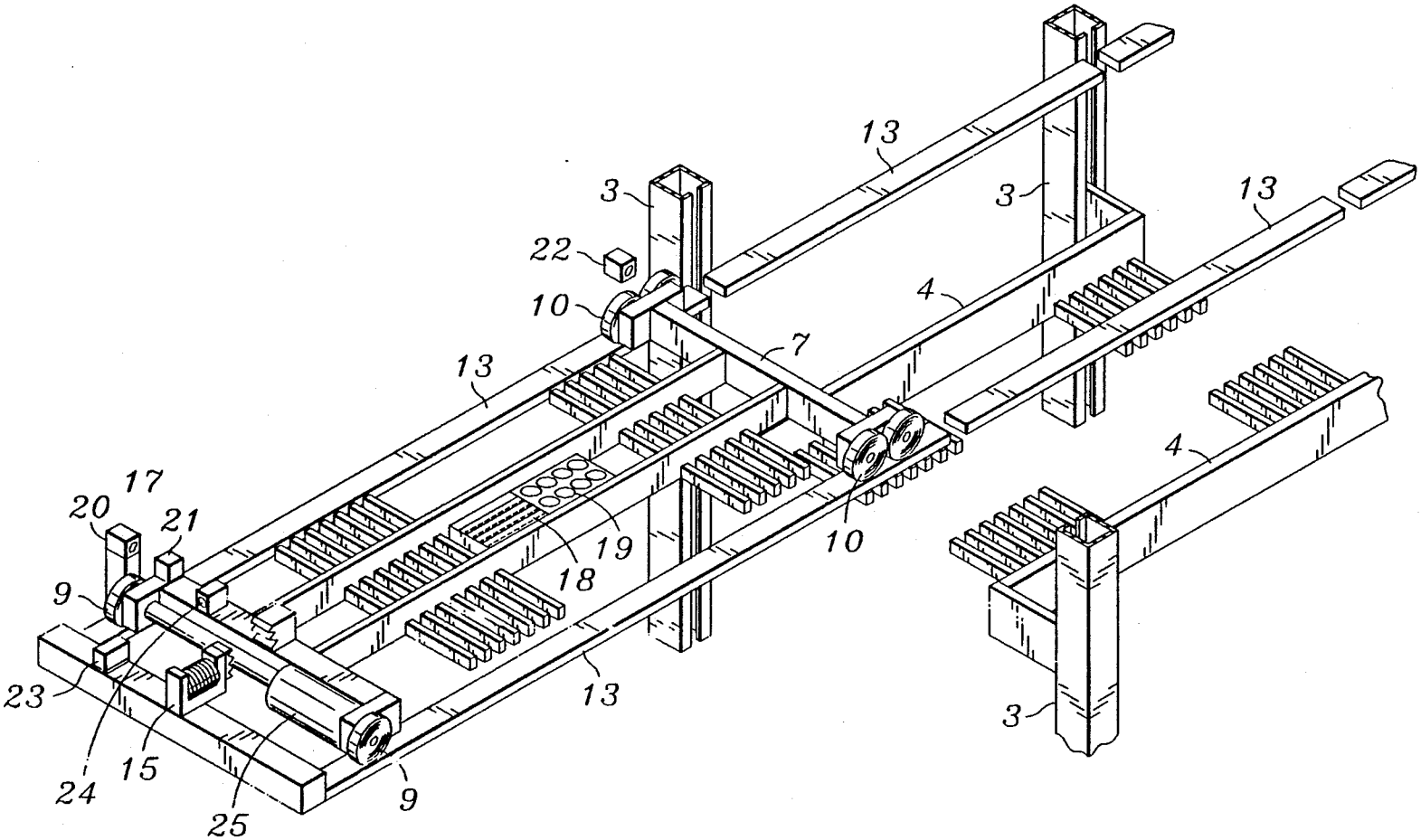
FIG. 7 is a perspective view showing another embodiment of the three dimensional parking system which includes a different arrangement of housing stations for accommodating vehicles.

(4) In the embodiment described above, the housing stations (X1, Y1, etc.) are provided on the right and left sides of the lift compartment 31. In another embodiment, the housing stations may be formed on the front and rear sides of the lift compartment, while the platform 7 is caused to travel in the longitudinal direction, as shown in FIG. 7.

INDUSTRIAL APPLICABILITY

As described herein in detail, by using the drive mechanism for the movable platform in order to carry the vehicle according to the present invention, maintenance on the three dimensional parking system is rendered easier than with conventional parking systems.

I claim:

1. A three dimensional parking system including a plurality of parking stations arranged in a vertical direction for receiving vehicles to be parked, the system comprising:

a pair of lifts for supporting the vehicle, each of the lifts having a plurality of lift fork beams formed in a comb-like arrangement;

a lift compartment disposed adjacent to the parking stations for enabling said lifts to vertically move among the parking stations;

the parking stations including a plurality of energy charging devices and a plurality of platforms for carrying the vehicles, said platforms being horizontally movable between the parking stations and said lift compartment;

each of said platforms including a plurality of drive wheels for allowing the platform to laterally move, a motor for driving said drive wheels, a controller for controlling said motor, an energy storage device, and a connector for connecting said energy storage device to said energy charging device when the platform is located in the parking station;

each of said platforms further including a plurality of platform fork beams formed to pass between said lift fork beams of the pair of lifts, whereby a vehicle is transferred between the pair of lifts and a selected platform located in a predetermined stop position within the lift compartment, by the cooperation of said lift fork beams and platform fork beams; and detection means for determining whether said selected platform is exactly located in said predetermined stop position within the lift compartment, said detection means including front detector pair comprising a first detector disposed in a front end of each platform and a first counter element arranged in said lift compartment for facing said first detector of the platform located in said predetermined stop position, and rear detector pair comprising a second detector disposed in a rear end of each platform and a second counter element arranged in said lift compartment for facing said second detector of the platform located in said predetermined stop positions, whereby said controller controls said motor in response to signals transmitted from said first and second detectors.

2. The parking system according to claim 1, wherein said first and second counter elements are emitters, and said first and second detectors are receptors for receiving signal radiations emitted from said emitters.

3. The parking system according to claim 1, wherein each of the parking stations includes a counter element for facing one of said first and second detectors when the platform is located in a predetermined position to be stopped within the parking station.

4. The parking system according to claim 1, wherein said controller incorporates a timer for measuring the time which elapsed after the commencement of the start of said platform, whereby the speed of said platform is controlled on the basis of the elapsed time.

5. The parking system according to claim 1 further comprising platform rails arranged in said parking stations and lift compartment, for allowing said platforms to travel thereon, whereby said platform rails arranged in said parking stations are separated from said platform rails arranged in said lift compartment by a gap, and wherein each of said drive wheels is formed of two adjacent wheels in a direction of movement of said platform, and wherein a distance between two adjacent wheels is set to a value greater than said gap between said platform rails.

* * * * *